US010321253B2

(12) United States Patent
Hollinshead et al.

(10) Patent No.: US 10,321,253 B2
(45) Date of Patent: Jun. 11, 2019

(54) ASYMMETRIC STEREOPHONIC BASS COMPENSATION

(71) Applicant: MERIDIAN AUDIO LIMITED, Huntingdon, Cambridgeshire (GB)

(72) Inventors: Richard Hollinshead, Windeck (DE); Michael Kapp, Huntingdon (GB); Alan Wood, Huntingdon (GB)

( * ) Notice: Subject to any disclaimer, the term of this patent is extended or adjusted under 35 U.S.C. 154(b) by 0 days.

(21) Appl. No.: 15/735,387

(22) PCT Filed: Jun. 15, 2016

(86) PCT No.: PCT/GB2016/051760
§ 371 (c)(1),
(2) Date: Dec. 11, 2017

(87) PCT Pub. No.: WO2016/203216
PCT Pub. Date: Dec. 22, 2016

(65) Prior Publication Data

US 2018/0192221 A1 Jul. 5, 2018

(30) Foreign Application Priority Data

Jun. 15, 2015 (GB) ..... 1510415.1

(51) Int. Cl.
*H04R 3/12* (2006.01)
*H04S 3/00* (2006.01)
(Continued)

(52) U.S. Cl.
CPC ..... *H04S 3/002* (2013.01); *H04R 1/26* (2013.01); *H04R 3/04* (2013.01); *H04R 3/12* (2013.01);
(Continued)

(58) Field of Classification Search
None
See application file for complete search history.

(56) References Cited

U.S. PATENT DOCUMENTS

2005/0063554 A1 3/2005 Devantier et al.
2010/0208900 A1 8/2010 Amadu et al.
(Continued)

FOREIGN PATENT DOCUMENTS

EP 2357846 A1 12/2009
WO 2009012497 A1 1/2009

OTHER PUBLICATIONS

Zumbahlen, Hank. "Allpass Filters." Analog.com, Analog Devices, 2012.*

(Continued)

*Primary Examiner* — James K Mooney
(74) *Attorney, Agent, or Firm* — Buckley, Maschoff & Talwalkar LLC

(57) ABSTRACT

An audio system for use in a confined space comprises N acoustic transducers, where N is an integer and N≥2. Each acoustic transducer is configured to receive an audio signal for a respective channel of the audio system and to generate an acoustic signal therefrom, and is operably coupled to a respective filter having a phase response. The phase response of at least one of the filters is different from the phase response of at least one other of the filters at a frequency f having a corresponding wavelength $\lambda=d/(n+\frac{1}{2})$, where n is an integer and n≥0 and d is a characteristic separation of two or more of the N acoustic transducers when in the confined space. Compensation is thereby achieved for a reduction in acoustic power that would otherwise occur over a range of frequencies of width Δf around frequency f.

20 Claims, 7 Drawing Sheets

(51) Int. Cl.
*H04R 1/26* (2006.01)
*H04R 3/04* (2006.01)

(52) U.S. Cl.
CPC ..... *H04R 2499/13* (2013.01); *H04S 2400/09* (2013.01)

(56) References Cited

U.S. PATENT DOCUMENTS

2010/0290643 A1 11/2010 Michelich et al.
2011/0235824 A1* 9/2011 Lehnert ..... H03G 9/005 381/94.8

OTHER PUBLICATIONS

"Combined Search and Examination Report under Sections 17 and 18(3)" for GB Application No. GB1510415.1 dated Nov. 23, 2015, 5 pp.
"International Search Report and Written Opinion" for PCT Application No. PCT/GB2016/051760 dated Sep. 5, 2015, 12 pp.

* cited by examiner

ASYMMETRIC STEREOPHONIC BASS COMPENSATION

CROSS-REFERENCE TO RELATED APPLICATIONS

This application is a U.S. National Stage filing under 35 U.S.C. § 371 and 35 U.S.C § 119, based on and claiming priority to PCT/GB2016/051760 for "ASYMMETRIC STEREOPHONIC BASS COMPENSATION" filed Jun. 15, 2016 and claiming priority to GB Application No. 1510415.1 filed Jun. 15, 2015.

FIELD OF THE INVENTION

The present invention relates to methods for improving bass output and efficiency where multiple loudspeakers are used in spaces which have dimensions comparable to the acoustic wavelength.

BACKGROUND OF THE INVENTION

In a two-channel stereophonic home loudspeaker system, output from the two loudspeakers is dispersed into the large volume of the room, so the loudspeakers radiate independently. The same is generally true for multichannel systems with more than two channels. Typical stereophonic audio signals are predominately monophonic at low frequencies. As such, the acoustic outputs from the left and right channel bass outputs will add at the listener's ear.

However, when such loudspeaker systems are used in more confined spaces, the assumption that the loudspeakers radiate independently may not apply. This in turn may result in undesirable acoustic artefacts in the listening space, which can mar the listener's experience of the sound.

For example, an automotive audio system may consist of loudspeakers mounted in the left and right vehicle doors, as shown in FIG. 1. In such an arrangement, the vehicle cabin size will typically be much smaller than a home listening room, and the confined space can lead to unwanted acoustic effects, such that certain frequencies may not be perceived as strongly as others.

A conventional solution to such problems is often to boost the power to the loudspeaker, for example driving a bass transducer unit, such as a woofer. Although this can ameliorate the problem, it is not an efficient solution, as the sound system consumes more power and may require more bulky amplifiers. Moreover, it may lead to increased volume at frequencies at which it is not desired. Another solution for boosting bass sound can be to include a separate sub-woofer to generate the acoustic signal at low frequencies. In an automobile audio system, a subwoofer may be located in the floor of the vehicle cabin. Again, although the use of a sub-woofer can lead to better bass sound, the system does tend to consume more power and requires the additional transducer unit and drive electronics. In some types of vehicles, such as sports cars, the limited space may preclude the use of a sub-woofer.

EP 2357846 A1 describes a bass management system for automatically equalizing the group delay in the low audio frequency range generated by an audio system. The management system addresses the issue of aligning phase and/or group delay in the audio system and does so automatically, whereas it is more common to optimize such systems by hand, particularly in confined spaces such as a vehicle cabin.

Notwithstanding the various techniques described above, there is a need for a more effective and efficient technique for dealing with unwanted acoustic artefacts, which can arise when implementing multichannel audio systems in confined spaces. This is particularly true for systems producing high quality sound and located in a small cabin of an automobile.

SUMMARY OF THE INVENTION

According to a first aspect of the present invention there is provided an audio system for use in a confined space, the audio system comprising:

N acoustic transducers, where N is an integer and $N \geq 2$, wherein each acoustic transducer is configured to receive an audio signal for a respective channel of the audio system and to generate an acoustic signal therefrom, wherein each of the N acoustic transducers is operably coupled to a respective filter having a phase response, wherein the phase response of at least one of the filters is different from the phase response of at least one other of the filters at a frequency f having a corresponding wavelength $\lambda = d/(n+\frac{1}{2})$ wherein n is an integer and $n \geq 0$ and d is a characteristic separation of two or more of the N acoustic transducers when in the confined space, in order to compensate for a reduction in acoustic power that would otherwise occur over a range of frequencies of width $\Delta f$ around said frequency f.

A key insight here is that destructive interference effects in relatively confined spaces can lead to acoustic anomalies in the sound field. Whilst such anomalies can sometimes be dealt with by boosting power, the invention seeks to address them by countering the destructive interference. In particular, the invention seeks to improve overall system performance when in a confined space by deliberately misaligning phase between acoustic transducers for one or more different channels, which is contrary to conventional thinking. In this way, it is possible to correct an acoustic anomaly arising from the confined space in which the acoustic transducers are located.

It is noted that the invention is particularly applicable to bass frequencies, which tend to have an acoustic wavelength that is comparable to the dimensions of the typical confined space in which the audio system may be used. Moreover, another key insight here is that at such low frequencies, maintenance of left to right symmetry in the confined space is much less important than at higher frequencies from the perspective of the listener, thereby allowing phase misalignment to be used.

Whilst the compensation technique of the present invention is specified with reference to a frequency f having a corresponding wavelength $\lambda = d/(n+\frac{1}{2})$, practical filters also provide for some phase compensation at frequencies above and below f, and so it is possible to achieve different compensation for the acoustic anomaly with a phase misalignment at a frequency somewhat detuned from the destructive interference frequency.

In some embodiments the filters are all-pass filters, which are particularly well suited to adjusting signal phase. In some preferred embodiments the filters are high-Q second-order all-pass filters.

Preferably, at least one of the filters has a characteristic response with a centre frequency greater than said frequency and at least one other of the filters has a characteristic response with a centre frequency less than said frequency f. This gives rises to a particular relative phase response around the frequency f which can be tailored to correct for the anomaly.

In other embodiments the N acoustic transducers are woofer drive units in N respective loudspeakers. Such units generate bass signals which are most often prone to destructive interference effects in a confine space. Compensation of the effect means that drive power need not be boosted nor a separate sub-woofer employed.

In some preferred embodiments, there are two acoustic transducers (N=2), which respectively form part of opposing loudspeakers separated by the separation d when in the confined space. This arrangement is well suited to a vehicle cabin and the like. In this case it is preferred that the phase responses of the two filters operably coupled to their respective acoustic transducers are asymmetric with respect to one another about said frequency f.

Particular phase responses may be chosen for the filters around the frequency at which the system is to be corrected. This will typically involve selecting the characteristic centre response frequency for the filter and also its quality factor.

Although the system will comprise at least N transducers associated with N channels, as described above, the system may comprise N groups of M acoustic transducers, where M is an integer and M≥2, wherein each acoustic transducer in a given group is configured to receive an audio signal for the respective channel of the audio system and to generate an acoustic signal therefrom.

Sometimes the other transducers in a given group may operate at different frequencies, such as mid-range and tweeter drive units, in which case the transducers of a given group will usually be arranged in a single loudspeaker unit. Instead or as well, there may be several transducers in a given group, which operate at the same frequency band, for example a number of woofer drive units. In this case compensation may be applied to the groups of similar transducers.

In some embodiments each of the N×M acoustic transducers is operably coupled to a respective filter having a phase response, wherein the phase response of the filters coupled to the M acoustic transducers in a given group is the same, and is different from the phase response of the filters coupled to the M acoustic transducers in at least one other group at the frequency f, in order to compensate for a reduction in acoustic power that would otherwise occur over the range of frequencies of width Δf around said frequency f.

In some other embodiments each of the N×M acoustic transducers is operably coupled to a respective filter having a phase response, wherein the phase response of at least one filter coupled to an acoustic transducer in a given group is different from the phase response of at least one other filter coupled to an acoustic transducer in the same group, and is also different from the phase response of at least one filter coupled to an acoustic transducer in at least one other group at the frequency f, in order to compensate for a reduction in acoustic power that would otherwise occur over the range of frequencies of width Δf around said frequency f.

The system of the present invention is well suited for operation in a range of confined spaces giving rise to acoustic anomalies. For example, the system is well suited to the cabin of an automobile, particularly the compact cabin of a sports car.

According to a second aspect of the present invention there is provided a method for compensating for a reduction in acoustic power of an acoustic signal in a confined space, said acoustic signal produced by an audio system comprising N acoustic transducers, where N is an integer and N≥2, wherein each acoustic transducer is configured to receive an audio signal for a respective channel of the audio system and to generate an acoustic signal therefrom, the method comprising the steps of:

filtering the audio signal to be received by at least two of the N acoustic transducers with a different phase response for each of the at least two acoustic transducers at a frequency having a corresponding wavelength $\lambda=d/(n+1/2)$, wherein n is an integer and n≥0 and d is a characteristic separation of two or more of the N acoustic transducers in the confined space, in order to compensate for a reduction in acoustic power that would otherwise occur over a range of frequencies of width Δf around said frequency f.

In some particular embodiments, where N=2 and the two acoustic transducers respectively form part of opposing loudspeakers separated by the separation d in the confined space, the audio signals to be received by the two acoustic transducers are filtered with phase responses having a predetermined phase difference at said frequency f. In some preferred embodiments the predetermined phase difference is 180° at said frequency f. Preferably, the phase responses are asymmetric with respect to one another about said frequency f.

In various embodiments, the method of the second aspect may reflect many of the embodiments of the device of the first aspect of the invention in terms of additional method steps.

According to a third aspect of the present invention there is provided a computer program product comprising executable code which when executed on a processor of an acoustic transducer system causes the system to perform the method of the second aspect.

In some embodiments the computer program product may be implemented as an update or enhancement to an existing digital signal processor (DSP), since no hardware changes may be required. In other embodiments the computer program product may be implemented as an update or enhancement to an existing multichannel or stereo audio processor.

According to a fourth aspect of the present invention there is generally provided a computer acoustic transducer system adapted to perform the method of the second aspect.

As will be appreciated by those skilled in the art, the present invention provides a new technique for compensating acoustic anomalies that can occur with multichannel audio systems in confined spaces having dimensions comparable to the acoustic wavelength. The precise implementation can be adapted according to the particular design and application, and further variations and embellishments will become apparent to the skilled person in light of this disclosure.

BRIEF DESCRIPTION OF THE DRAWINGS

Examples of the present invention will now be described in detail with reference to the accompanying drawings, in which.

DETAILED DESCRIPTION

As will be described, the present invention provides a new technique for compensating for acoustic anomalies that may occur when a multichannel audio system is located in a relatively confined space.

Figure 1:
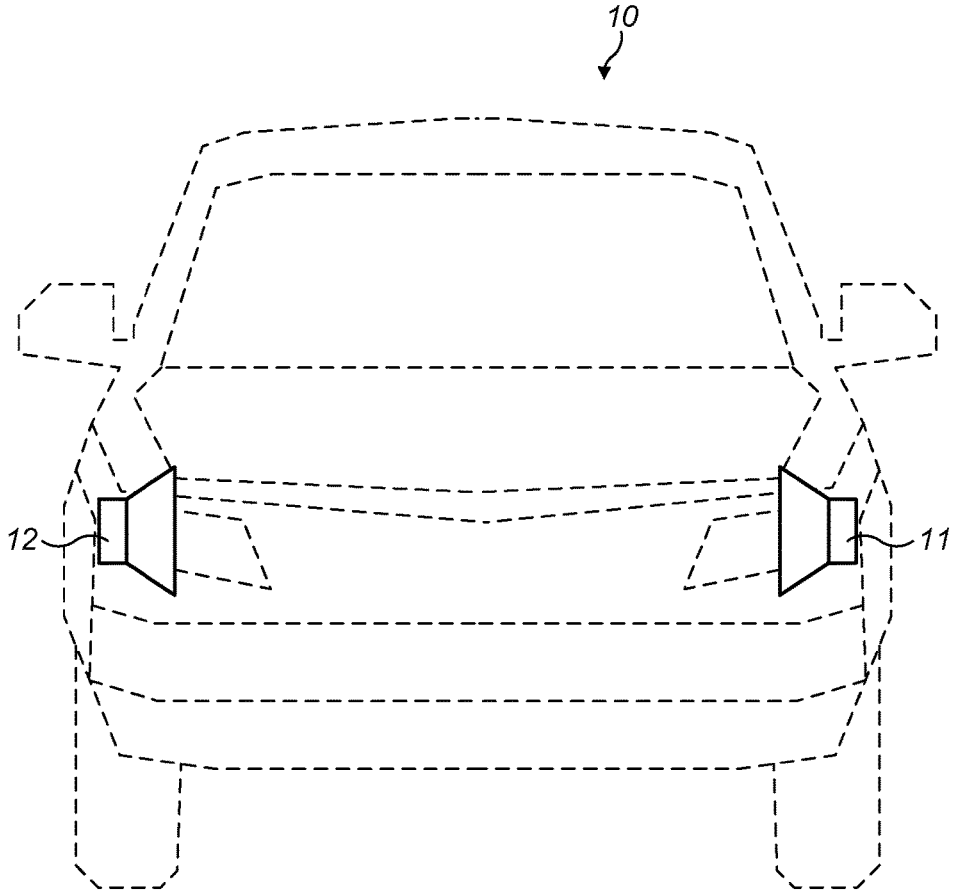
FIG. 1 shows schematically the typical arrangement of loudspeakers in an automotive audio system.

With an automotive audio system of the type 10 shown in FIG. 1, the separation of the vehicle doors essentially defines the separation of the opposing left and right loudspeakers, 11 and 12, as these are commonly positioned in the left and right side door panels. When the loudspeakers are driven with identical signals, destructive interference can occur at acoustic frequencies f where the distance between the loudspeakers corresponds to an odd number of half wavelengths of the acoustic signal, $(n+\frac{1}{2})\lambda$, for example ½, 1½, 2½ wavelengths.

This can result in reduced output and reduced efficiency at frequencies corresponding to these distinctive wavelengths. The strongest effect will tend to occur at the frequency corresponding to a ½ wavelength separation of the opposing loudspeakers. This frequency can be calculated from $f=v_s/2d$, where $v_s=340$ m/s is the speed of sound in air, and d is the separation of the two loudspeakers. For an automotive audio system of the type shown in FIG. 1, the vehicle doors are typically 1.5 m to 2 m apart. A loudspeaker separation of 1.5 m corresponds to a frequency of f=113 Hz, which corresponds to a bass acoustic frequency.

Figure 2:
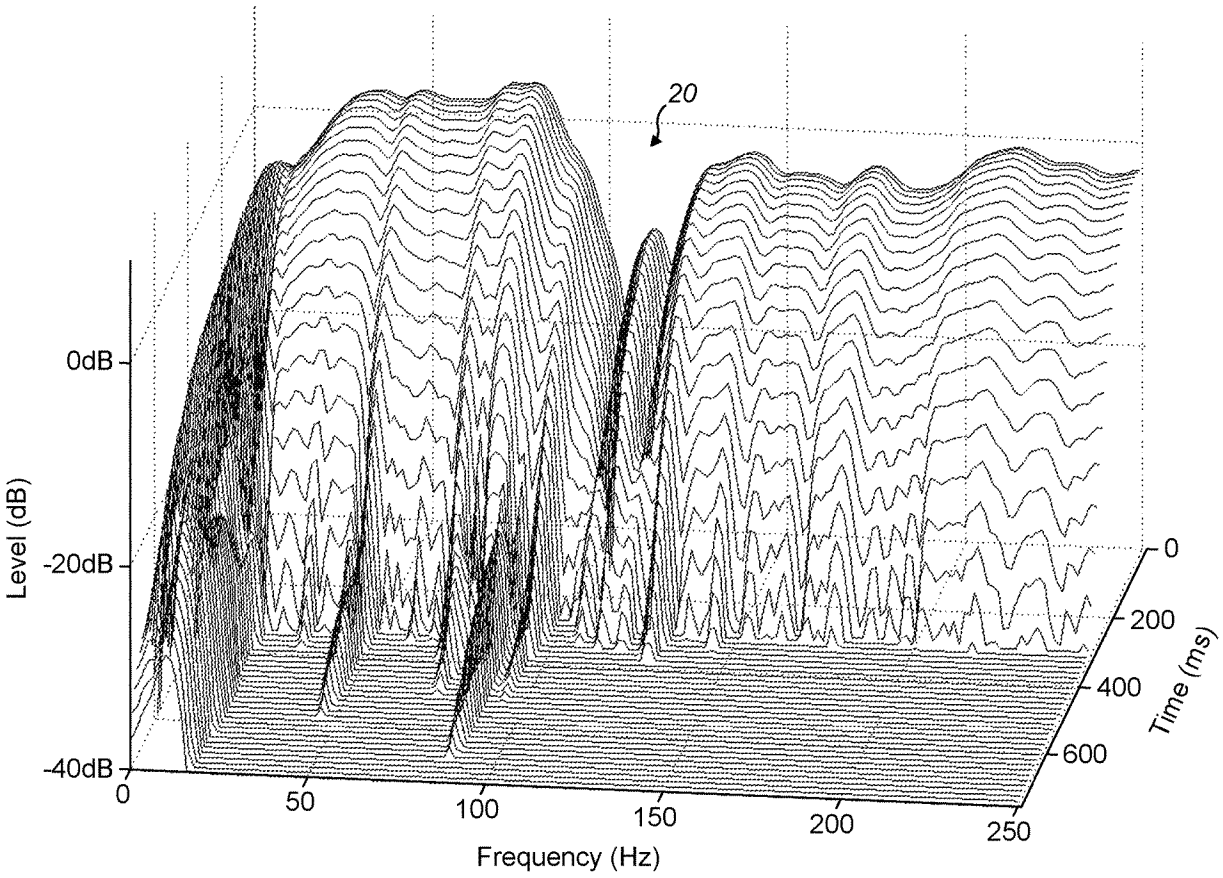
FIG. 2 shows the spectral content of the bass acoustic signal measured in an automotive audio system of the type shown in FIG. 1.

The destructive interference can lead to an unwanted notch in the frequency response of the audio system as measured at the vehicle occupant's head. FIG. 2 illustrates just such a notch 20 in the measured frequency content of an acoustic field produced by an automotive audio system in the cabin of a vehicle. As is apparent, the acoustic bass power is suppressed at a frequency f of approximately 113 Hz and over a spread of frequencies of width Δf around this frequency.

Thus, the notch 20 visible in FIG. 2 represents not only a poor frequency response, but also a loss of acoustic bass output power, which will significantly impact the quality of the audio experience of the listener. Equalisation of this notch is possible, but it would require a great increase in amplifier power and loudspeaker cone movement. Instead, and in accordance with the invention, a better solution is to prevent the destructive interference from occurring as far as is possible.

At mid and high frequencies, the left and right channels of a stereophonic audio system must be treated near identically to preserve the position of sounds in the stereo image. However, a key insight here is that, at low frequencies in a vehicle cabin, maintenance of this left to right symmetry is much less important than is efficiently correcting a notch of the type shown in FIG. 2. Accordingly, the left and right bass signals can be processed slightly differently.

Thus, in contrast to conventional systems, the invention treats the phase response of the left and right channels differently, but does so only over a narrow frequency range corresponding to the unwanted notch. The desired effect generally requires the outputs of the two loudspeakers to be 180° out of phase at the notch frequency. However, other phase alignments may be used according to the nature or severity of the acoustic anomaly.

One embodiment of the invention employs two high-Q second-order all-pass filters in order to implement the correction. A filter is provided for each of the two channels, with characteristic centre frequencies respectively above and below the frequency at which the unwanted destructive interference occurs.

Figure 3:
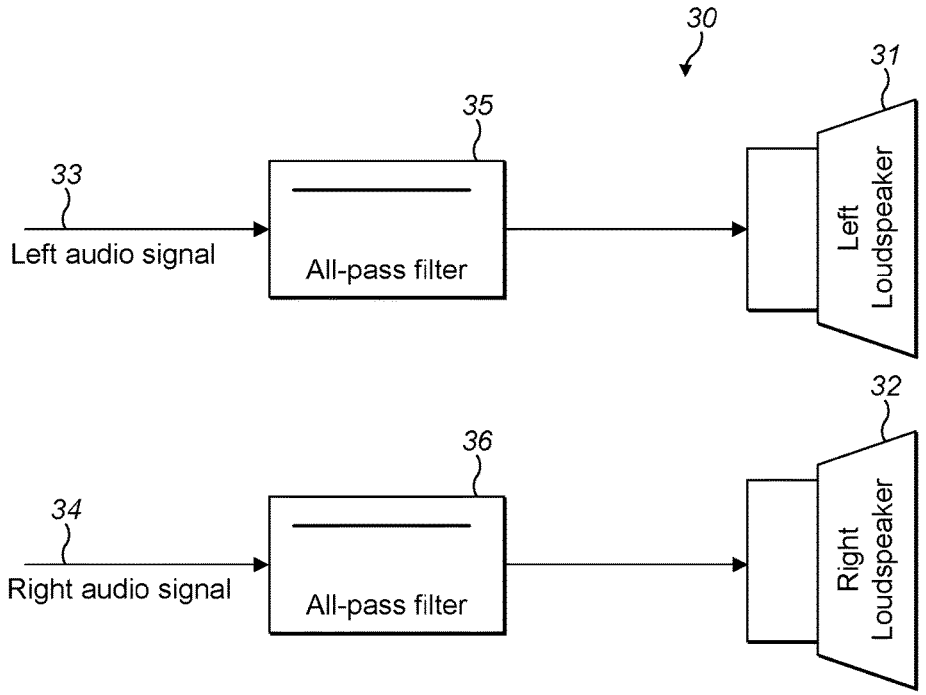
FIG. 3 shows schematically an embodiment of the invention implemented in a two channel loudspeaker system.

FIG. 3 illustrates such a simple dual loudspeaker system. In this arrangement the left audio signal, 33, passes through a high-Q second order all-pass filter, 35, whilst simultaneously the time-aligned right audio signal, 34, passes through its high-Q second order all-pass filter, 36. The two all-pass filters 35 and 36 are selected to have characteristic centre frequencies slightly above and slightly below the targeted compensation frequency, respectively. The filtered signals are then fed to the respective left and right loudspeakers, 31 and 32.

In this embodiment, the transfer functions of the two all-pass filters in the s-domain are selected to be as follows:

$$H_L(s) = \frac{s^2 - \frac{R_L}{Q}S + R_L^2}{s^2 + \frac{R_L}{Q}S + R_L^2}$$

$$H_H(s) = \frac{s^2 - \frac{R_H}{Q}S + R_H^2}{s^2 + \frac{R_H}{Q}S + R_H^2}$$

where $H_L(s)$ is the response for the lower frequency filter and $H_H(s)$ is the response for the higher frequency filter. The lower frequency filter may be used with either one of the left or right loudspeakers provided the higher frequency filter is used with the other one of the left or right loudspeakers.

In the above frequency responses the parameters $R_H=\omega\times r$ and $R_L=\omega/r$, where ω is the angular frequency ($\omega=2\pi f$) corresponding to the notch centre frequency (f), r is a ratio chosen in dependence on the width Δf of the notch frequency range to be corrected, and Q is the quality factor of the filters which is chosen to provide a 180° phase difference at the notch centre frequency f.

Figure 4:
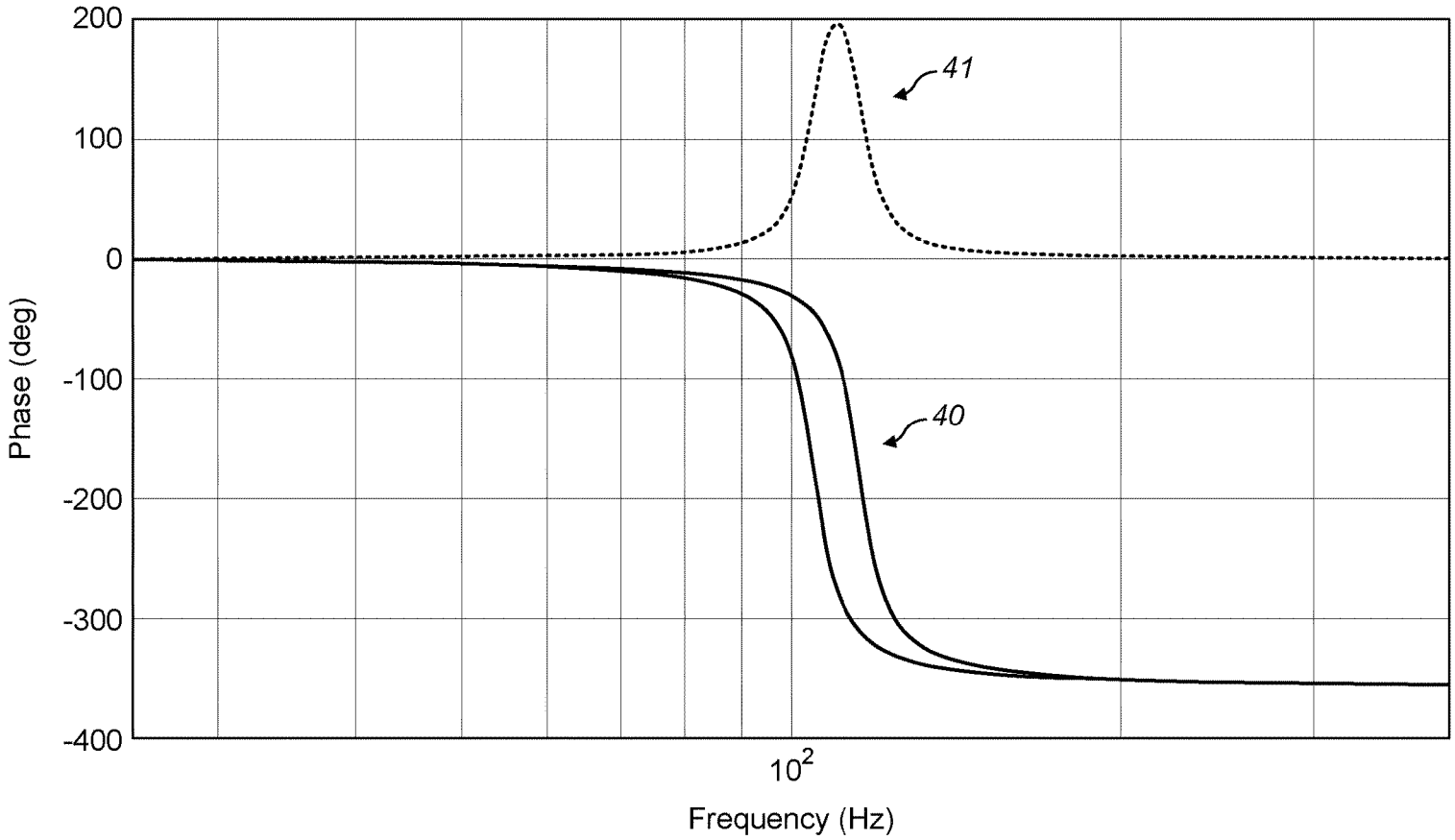
FIG. 4 shows example individual and relative phase responses of the two all-pass filters used in a two channel loudspeaker system of the type shown in FIG. 3.

The two lower curves 40 of FIG. 4 show the phase response of the two all-pass filters described above and the upper curve 41 shows the relative phase response of the two filters. In this example, the centre frequencies for the lower and higher frequency filters are 104.9 Hz and 115.4 Hz, respectively, and the quality factor Q of the filters is 12. As can be seen, the filter phase responses are asymmetric with a 180° phase difference at the chosen frequency f and give rise to a non-zero relative phase response in a frequency band around the notch centre frequency f.

Figure 5:
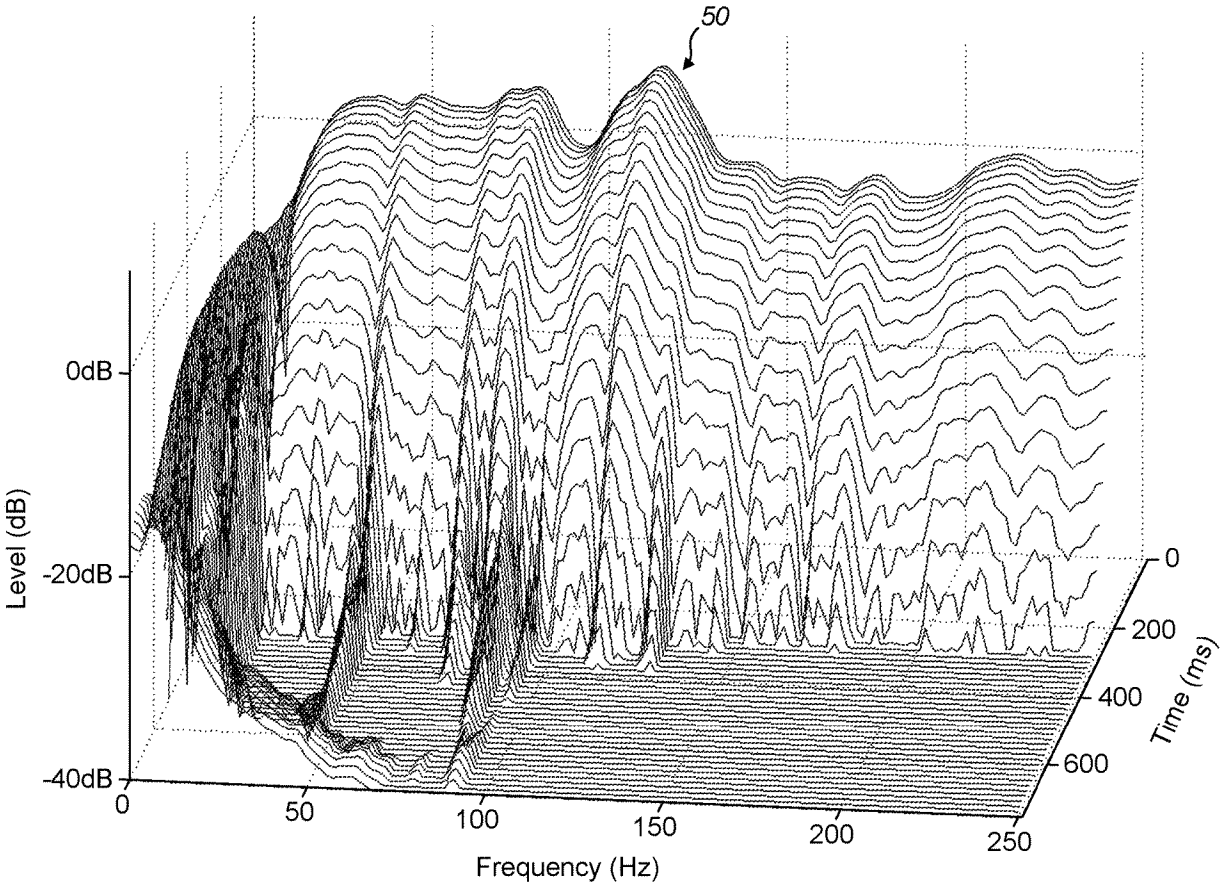
FIG. 5 shows the spectral content of the bass acoustic signal measured in an automotive audio system of the type shown in FIG. 1 when employing the compensated loudspeakers of FIG. 3.

FIG. 5 shows the measured frequency content of an acoustic field produced by the automotive audio system in the cabin of the vehicle when the all-pass filter correction is applied to the left and right audio signals with the filter phase responses shown in FIG. 4. As can be seen, it is apparent that there is no notch at 50 and no loss of acoustic bass power when compared to the measured frequency content shown in FIG. 2 for the same system without phase compensation. The frequency response of the system over the bass range shown is much more uniform.

Figure 6:
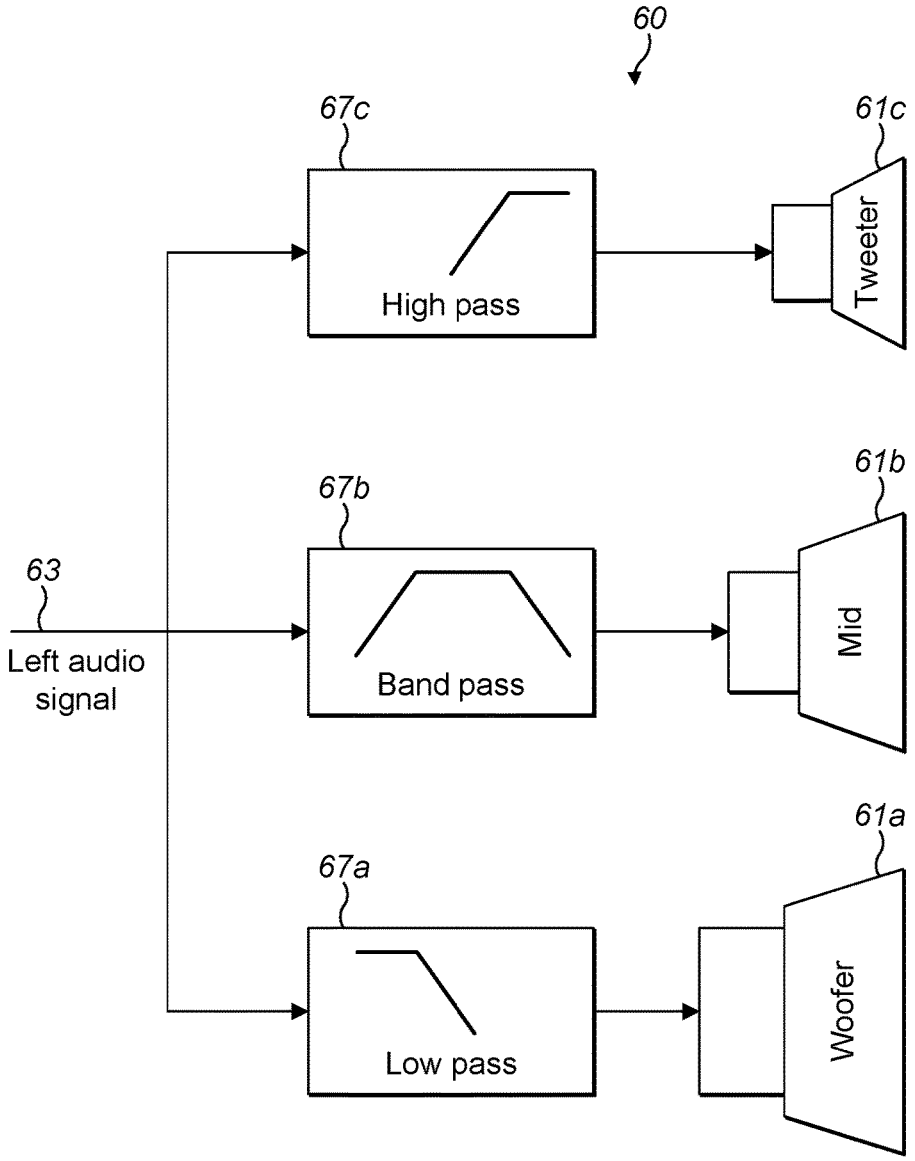
FIG. 6 shows schematically the typical arrangement of a three-way loudspeaker for use in a two channel stereophonic system; and, FIG. 7 shows schematically an embodiment of the invention implemented in the three-way loudspeaker shown in FIG. 6.

Although the audio system has been described so far as a two channel system with a single loudspeaker for each channel, the system may actually comprise more than two channels and/or each loudspeaker may include more than one acoustic transducer. FIG. 6 shows a schematic representation of the units within a typical three-way loudspeaker 60. As illustrated, the loudspeaker contains three acoustic transducers in the form of the following drive units: a tweeter, 61*c*; a mid-range, 61*b*, and a woofer, 61*a*, for generating higher, mid-range, and bass acoustic frequencies, respectively.

The loudspeaker may form part of a two channel stereophonic system, and receive the left channel audio signal 63, as shown. As illustrated, the signal 63 is effectively passed through a different filter or set of filters for each drive unit, namely a high pass filter 67*c* for the tweeter 61*c* drive unit signal; a band pass filter 67*b* for the mid-range 61*b* drive unit signal; and a low pass filter 67*a* for the woofer 61*a* drive unit signal. In this way, the overall audio signal is filtered so that only the appropriate frequency band of the signal is used to drive the respective acoustic transducer. In a two channel stereophonic system, the loudspeaker receiving the right channel will typically be configured in a similar manner. A similar loudspeaker arrangement may also be used in a multichannel system with more than two channels.

When such a loudspeaker configuration is used in an automotive audio system of the type shown in FIG. 1, then acoustic anomalies may arise in the bass signal for the reasons previously described, whereas there may be no or negligible anomaly problems associated with the higher frequency and mid-range frequencies. In such a situation, the invention can still be used to achieve bass compensation by further filtering the signal to the woofer unit in the manner shown in FIG. 7.

Figure 7:
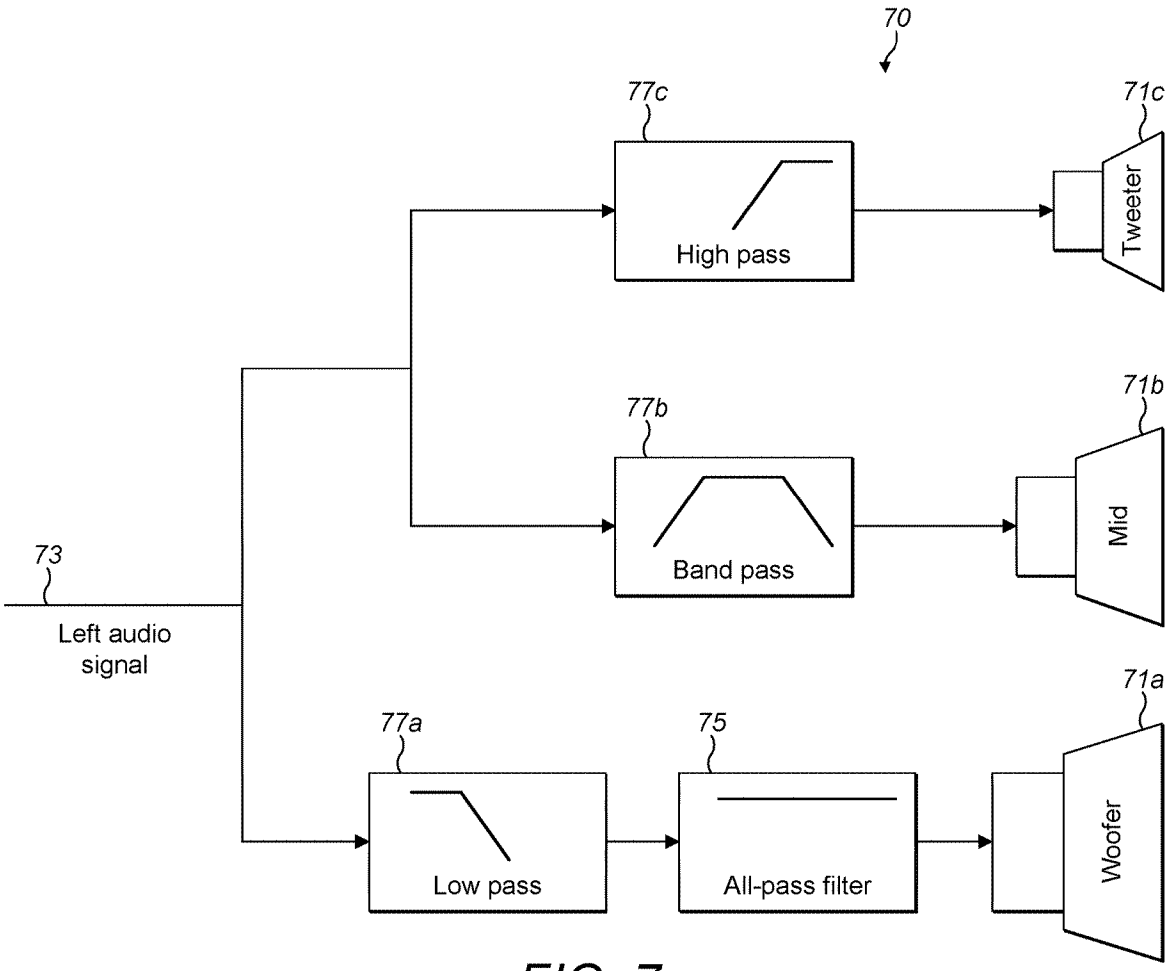

As shown in FIG. 7, the loudspeaker arrangement of FIG. 6 has been adapted 70 to effectively include an all-pass filter 75 in the signal chain driving the woofer unit 71*a* between the low pass filter 77*a* and the woofer drive unit 71*a*. A similar adaptation would be made to each three-way loudspeaker in the multichannel audio system, and the all-pass-filters would be selected with different phase responses in accordance with the invention to compensate for anomalies in the resultant composite acoustic bass signal. In a two channel stereophonic system, the right loudspeaker would be a replica of the left loudspeaker and the all-pass filters for the left and right woofers could be implemented in the manner described above, with characteristic centre frequencies above and below the unwanted notch frequency.

In this way, the mid-range and higher frequencies are treated identically for each channel, thereby preserving the positions of acoustics sounds in a stereo image, for example, whereas the bass frequencies are treated differently for each channel to deal with unwanted anomalies occurring in the bass frequency range.

The system may generally contain groups of acoustic transducers responsive to a particular channel of the audio system. Some of the transducers in a group may operate at the same frequency band and some may operate at different frequency bands. Some of the transducers in a group may be located within a single loudspeaker unit and some may be separate. If required, compensation using filters according to the invention may be applied between transducers within a given group, as well as between transducers from separate groups. In a stereophonic system containing two groups of similar acoustic transducers, but differently located, different compensation may be applied between corresponding transducer in the two groups.

Some system configurations might lead to an undesirable group delay arising from a crossover between lower and higher frequencies. In such situations, the compensation technique of the present invention may advantageously be combined with the group delay equalisation technique described in published International patent application WO2014106756A1, the content of which is herein incorporated by reference. When combining the two techniques in a single audio system, it may be possible to consolidate and optimise the filters to achieve the desired effect in an efficient design.

In summary, the present invention provides a new compensation technique for use with multichannel loudspeaker audio systems in confined spaces to remove unwanted acoustic artefacts resulting from the confined space. The compensation can be implemented in a number of different configurations according to the particular application. Without loss of generality, the teaching of the embodiments described above may be combined into arbitrarily complex systems. Moreover, as will be appreciated by those skilled in the art, various modifications of the invention are possible based on the foregoing teaching.

The invention claimed is:

1. An audio system for use in a confined space, the audio system comprising:

N acoustic transducers, where N is an integer and $N \geq 2$, wherein each acoustic transducer is configured to receive an audio signal for a respective channel of the audio system and to generate an acoustic signal therefrom, wherein each of the N acoustic transducers is operably coupled to a respective filter having a phase response, wherein the phase response of at least one of the filters is different from the phase response of at least one other of the filters at a frequency f having a corresponding wavelength $\lambda = d/(n+\frac{1}{2})$ wherein n is an integer and $n \geq 0$ and d is a characteristic separation of two or more of the N acoustic transducers when in the confined space, in order to compensate for a reduction in acoustic power that would otherwise occur over a range of frequencies of width $\Delta f$ around said frequency f.

2. The audio system according to claim 1, wherein the filters are all-pass filters.

3. The audio system according to claim 2, wherein the filters are high-Q second-order all-pass filters.

4. The audio system according to claim 2, wherein at least one of the filters has a characteristic response with a centre frequency greater than said frequency f and at least one other of the filters has a characteristic response with a centre frequency less than said frequency f.

5. The audio system according to claim 1, wherein the N acoustic transducers are woofer drive units in N respective loudspeakers.

6. The audio system according to claim 1, wherein N=2 and the two acoustic transducers respectively form part of opposing loudspeakers separated by the separation d when in the confined space.

7. The audio system according to claim 6, wherein the phase responses of the two filters operably coupled to their respective acoustic transducers are asymmetric with respect to one another about said frequency f.

8. The audio system according to claim 6, wherein the phase response for one of the two speakers is $$H_L(s) = \frac{s^2 - \frac{R_L}{Q}S + R_L^2}{s^2 + \frac{R_L}{Q}S + R_L^2}$$

and the phase response for the other of the two speakers is $$H_H(s) = \frac{s^2 - \frac{R_H}{Q}S + R_H^2}{s^2 + \frac{R_H}{Q}S + R_H^2}$$

where $R_H=\omega\times r$ and $R_L=\omega/r$, and where $\omega$ is the angular frequency ($\omega=2\pi f$) corresponding to said frequency, r is a ratio chosen in dependence on the width $\Delta f$ of the frequency range to be corrected, and Q is the quality factor of the filters which is chosen to provide a predetermined phase difference at said frequency f.

9. The audio system according to claim 8, wherein the quality factor Q of the filters is chosen to provide a phase difference of 180° at said frequency f.

10. The audio system according to claim 1, wherein the system comprises N groups of M acoustic transducers, where M is an integer and M≥2, wherein each acoustic transducer in a given group is configured to receive the same audio signal for the respective channel of the audio system and to generate an acoustic signal therefrom.

11. The audio system according to claim 10, wherein each of the N×M acoustic transducers is operably coupled to a respective filter having a phase response, wherein the phase response of the filters coupled to the M acoustic transducers in a given group is the same, and is different from the phase response of the filters coupled to the M acoustic transducers in at least one other group at the frequency f, in order to compensate for a reduction in acoustic power that would otherwise occur over the range of frequencies of width $\Delta f$ around said frequency f.

12. The audio system according to claim 10, wherein each of the N×M acoustic transducers is operably coupled to a respective filter having a phase response, wherein the phase response of at least one filter coupled to an acoustic transducer in a given group is different from the phase response of at least one other filter coupled to an acoustic transducer in the same group, and is also different from the phase response of at least one filter coupled to an acoustic transducer in at least one other group at the frequency f, in order to compensate for a reduction in acoustic power that would otherwise occur over the range of frequencies of width $\Delta f$ around said frequency f.

13. The audio system according to claim 1, wherein the confined space is a cabin of an automobile.

14. A method of compensating for a reduction in acoustic power of an acoustic signal in a confined space, said acoustic signal produced by an audio system comprising N acoustic transducers, where N is an integer and N≥2, wherein each acoustic transducer is configured to receive an audio signal for a respective channel of the audio system and to generate an acoustic signal therefrom, the method comprising the steps of:

filtering the audio signal to be received by at least two of the N acoustic transducers with a different phase response for each of the at least two acoustic transducers at a frequency having a corresponding wavelength $\lambda=d/(n+½)$, wherein n is an integer and n≥0 and d is a characteristic separation of two or more of the N acoustic transducers in the confined space, in order to compensate for a reduction in acoustic power that would otherwise occur over a range of frequencies of width $\Delta f$ around said frequency f.

15. The method according to claim 14, wherein N=2 and the two acoustic transducers respectively form part of opposing loudspeakers separated by the separation d in the confined space, and wherein the audio signals to be received by the two acoustic transducers are filtered with phase responses having a predetermined phase difference at said frequency f.

16. The method according to claim 15, wherein the predetermined phase difference is 180° at said frequency f.

17. The method according to claim 15, wherein the phase responses are asymmetric with respect to one another about said frequency f.

18. A non-transitory computer-readable medium storing computer-readable instructions that, when executed, cause a processor of an acoustic transducer system to perform steps of a method for reduction in acoustic power of an acoustic signal in a confined space, said acoustic signal produced by an audio system comprising N acoustic transducers, where N is an integer and N≥2, wherein each acoustic transducer is configured to receive an audio signal for a respective channel of the audio system and to generate an acoustic signal therefrom, the steps comprising:

filtering the audio signal to be received by at least two of the N acoustic transducers with a different phase response for each of the at least two acoustic transducers at a frequency having a corresponding wavelength $\lambda=d/(n+½)$, wherein n is an integer and n≥0 and d is a characteristic separation of two or more of the N acoustic transducers in the confined space, in order to compensate for a reduction in acoustic power that would otherwise occur over a range of frequencies of width $\Delta f$ around said frequency f.

19. The non-transitory computer-readable medium storing computer-readable instructions of claim 18 implemented as an update or enhancement to an existing digital signal processor (DSP) loudspeaker system.

20. The non-transitory computer-readable medium storing computer-readable instructions of claim 18 implemented as an update or enhancement to an existing multichannel or stereo audio processor.

* * * * *